US010486018B2

(12) United States Patent
Jiang

(10) Patent No.: US 10,486,018 B2
(45) Date of Patent: Nov. 26, 2019

(54) PASSIVE-TYPE TREADMILL

(71) Applicant: Peigen Jiang, Sammamish, WA (US)

(72) Inventor: Peigen Jiang, Sammamish, WA (US)

( * ) Notice: Subject to any disclaimer, the term of this patent is extended or adjusted under 35 U.S.C. 154(b) by 143 days.

(21) Appl. No.: 15/901,275

(22) Filed: Feb. 21, 2018

(65) Prior Publication Data

US 2019/0255380 A1 Aug. 22, 2019

(51) Int. Cl.

| | |
|---|---|
| ***A63B 22/02*** | (2006.01) |
| ***A63B 21/02*** | (2006.01) |
| ***A63B 21/22*** | (2006.01) |

(52) U.S. Cl.

CPC ..... *A63B 22/02* (2013.01); *A63B 21/02* (2013.01); *A63B 21/22* (2013.01)

(58) Field of Classification Search

None

See application file for complete search history.

(56) References Cited

U.S. PATENT DOCUMENTS

| | | | | |
|---|---|---|---|---|
| 8,147,386 | B2 * | 4/2012 | Farnsworth | A63B 23/1209 482/121 |
| 8,961,373 | B2 * | 2/2015 | Halver | A63B 21/157 482/51 |
| 9,480,871 | B2 * | 11/2016 | Domesick | A63B 23/02 |
| 9,675,838 | B2 * | 6/2017 | Manzke | A63B 21/00069 |
| 9,814,930 | B2 * | 11/2017 | Manzke | A63B 22/02 |
| 10,376,734 | B1 * | 8/2019 | Razon | A61B 5/112 |
| 2010/0056348 | A1 * | 3/2010 | James | A63B 21/00069 482/127 |
| 2014/0274578 | A1 * | 9/2014 | Kennedy | A63B 21/015 482/54 |
| 2018/0093125 | A1 * | 4/2018 | Johnson | A63B 21/4027 |

* cited by examiner

*Primary Examiner* — Stephen R Crow

(57) ABSTRACT

A passive-type treadmill is disclosed which includes a closed-loop belt rolling around a first and a second roller for providing a running platform, the first and second rollers being space apart, a resistance wheel contacting the first roller for providing resistance to the rotation of the first roller, the resistance wheel being capable of rotating around a shaft, and a spring urging the shaft and thus the resistance wheel against the first roller.

20 Claims, 3 Drawing Sheets

PASSIVE-TYPE TREADMILL

BACKGROUND

The present invention relates generally to a physical exercise apparatus, and, more particularly, to a passive-type treadmill.

Treadmills are widely utilized for performing vigorous exercise indoors and at a stationary position. Such treadmills typically include an elongated closed-loop belt driven by rollers and supported by an underlying rigid deck. The rollers are often driven by an electric motor, typically at an adjustable speed. However, such motorized treadmills are often noisy as a runner pounds the running deck, and can be dangerous if the runner lost a step. What desired is a treadmill that is both quiet and safe.

Figure 1:
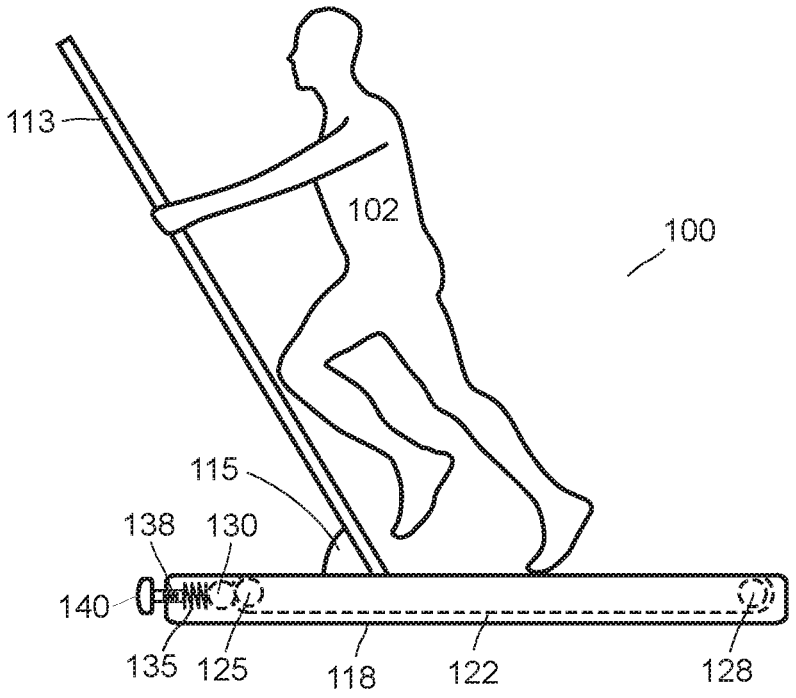
FIG. 1 is a side-view of a passive-type treadmill according to an embodiment of the present disclosure.

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein.

DESCRIPTION

The present disclosure relates to a passive-type treadmill. A preferred embodiment of the present disclosure will be described hereinafter with reference to the attached drawings.

FIG. 1 is a side-view of a passive-type treadmill 100 according to an embodiment of the present disclosure. A person 102 walks on closed-loop belt 122 which is supported by a deck (not shown). The person 102 leans slightly forward supporting his upper body with his hands on a handrail 113. The closed-loop belt 122 rolling around two spaced apart rollers 125 and 128. According to embodiments of the present disclosure, the rollers 125 and 128 is not motorized, so that the person 102 uses his feet to push the closed-loop belt 122 backward for exercise purposes. The deck that supports the closed-loop belt 122 is rigidly mounted to a frame 118. As shown in FIG. 1, the handrail 113 is also rigidly mounted to the frame 118 with an enforcement member 115.

Referring again to FIG. 1, the front roller 125 is squeezed by a resistance roller 130 as a part of a resistance controller, so that the closed-loop belt 122 will not be moved freely. The resistance roller 130 is pushed toward the roller 125 by a spring 135, which in turn is pushed by a bolt 138. A knob 140 facilitates the rotation of the bolt 138 to move back and forth horizontally for adjusting pressure between the resistance roller 130 and the front roller 125. In embodiments, the resistance roller 130 is made of a rubber material, while the front roller 125 is made of a hard material such as steel or plastic.

Figure 2:
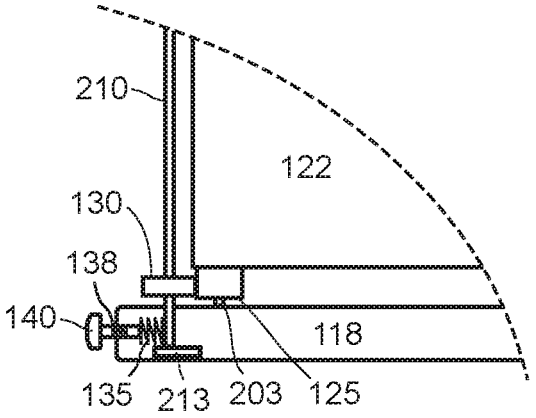
FIG. 2 is a top view of a part of the passive-type treadmill of FIG. 1.

FIG. 2 is a top view of a part of the passive-type treadmill 100 of FIG. 1 further illustrating the resistance controller which includes the resistance roller 130 being pushed against the front roller 125 by the spring 135. The front roller 125 rotates around a shaft 203 which is mounted to the from 118. The resistance roller 130 rotates around a shaft 210 which is secured to the frame 118 by a mounting plate 213. The mounting plate 213 has a horizontal slot (not shown) allowing the shaft 210 to slightly move back and forth in a substantial horizontal direction under the urge of the spring 135. When the bolt 138 is screwed more into the frame 118, the spring 135 pushes the shaft 210 closer to the front roller 125, then the rubber resistance roller 130 is more squeezed and provides greater resistance to the rotation of the front roller 125. Conversely, when the spring 135 is more relaxed by bolt 138, the rubber resistance roller 130 is less squeezed and provides lesser resistance to the rotation of the front roller 125.

Although FIG. 2 shows only one corner of the running platform of the passive-type treadmill 100, an ordinary skilled in the art would recognize that the running platform is symmetrical. A resistance controller including a resistance roller and a spring can be symmetrically arranged on the other end of the front-roller 125.

Figure 3:
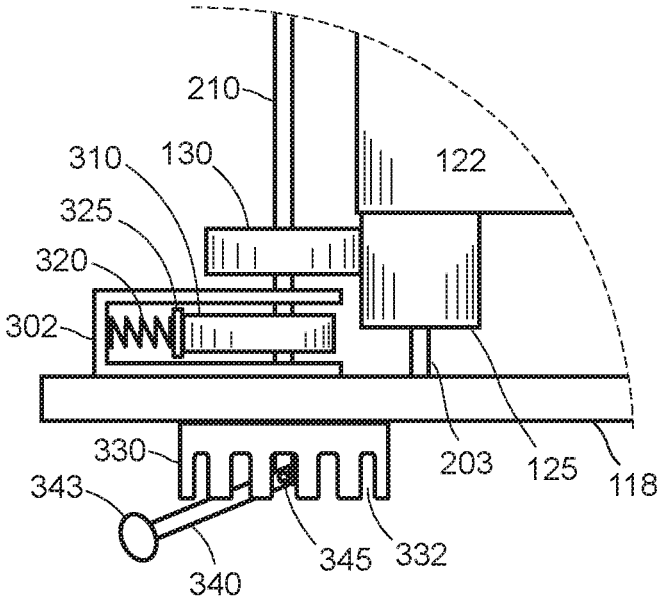
FIG. 3 illustrates a second embodiment of the resistance controller for the passive-type treadmill of the present disclosure.

FIG. 3 illustrates a second embodiment of the resistance controller for the passive-type treadmill 100 of the present disclosure. This resistance controller also includes the resistance roller 130 squeezed against the front roller 125, and a spring 320 that urges the resistance roller 130 against the front roller 125. However, the force of the spring 320 is adjusted by rotating an oval wheel 310 fixed on the shaft 210. In one embodiment, the shaft 210 is secured by a U-shaped frame 302 in a pair of slots (not shown) that allows the shaft 210 to rotate and slightly move back and forth in a horizontal direction. A plate 325 is attached to one end of the spring 320 and makes a smooth contact with the oval wheel 310 to allow easy rotation thereof. The plate 325 can be made of a metal or a plastic material.

Referring again to FIG. 3, rotation of the shaft 210 and thus the oval wheel 310 is controlled by a handle 340 which is pivotally attached to an end of the shaft 210 with a pin 345. The end of the shaft 210 extends through a hole (not shown) in the frame 118. The handle 340 can be secured to a desired position by a holding plate 330 having a plurality of slots 332. When the handle 340 pivots away from the frame 118, the handle disengages the holding plate 330 and can be rotated freely. When the handle 340 slides into a slot 332, the handle 340 and thus the shaft 210 is maintained in an angle. As shown in FIG. 3, a knob 343 is attached to an end of the handle 340 for easy operation of the handle 340.

Figure 4A:
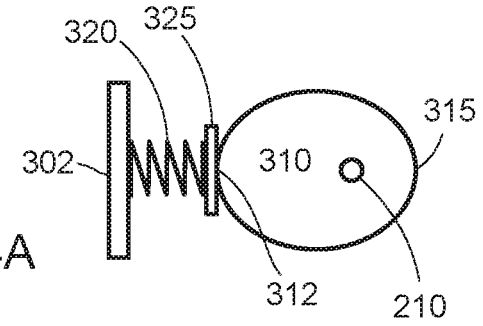
FIGS. 4A and 4B illustrate the working of the oval wheel for resistance adjustment.
Figure 4B:
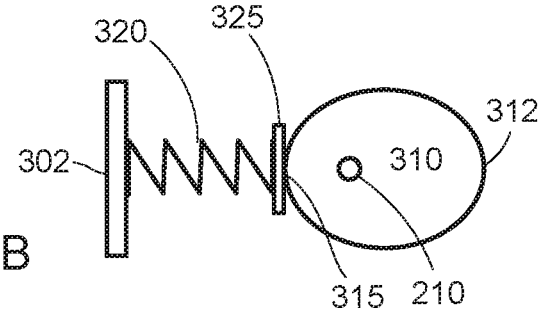

FIGS. 4A and 4B illustrate the working of the oval wheel 310 for resistance adjustment. Referring to FIG. 4A, the oval wheel 310 rotates to a position where a point 312 meets the plate 325. As the shaft 210 is located off centered, a distance between the shaft 210 and circumference of the oval wheel at the point 312 is long. As a result, the spring 320 is depressed and thus exerts a strong force on the shaft 210.

Referring to FIG. 4B, the oval wheel 310 rotates to a position where a point 315 meets the plate 325. A distance between the shaft 210 and circumference of the oval wheel at the point 315 is short. As a result, the spring 320 is relaxed and thus exerts a lesser force on the shaft 210.

Figure 5A:
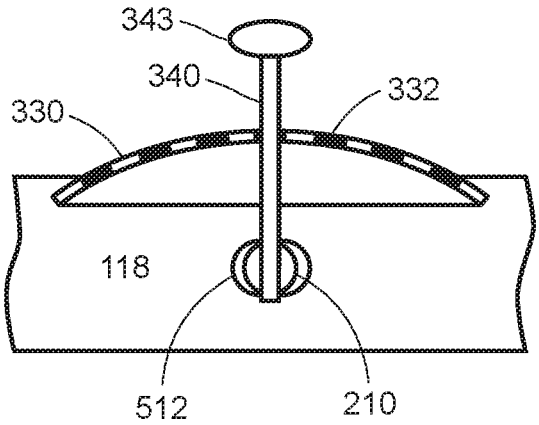
FIGS. 5A and 5B illustrate the working of the handle for resistance adjustment.
Figure 5B:
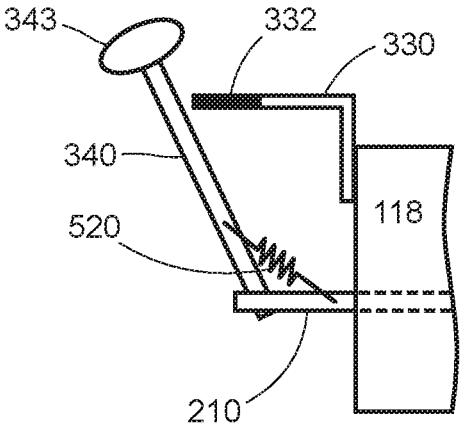

FIGS. 5A and 5B illustrate the working of the handle 340 for resistance adjustment. Referring to FIG. 5A, the frame 118 has a hole 512 for the shaft 210 to extend through. The hole 512 has room for the shaft 210 to slightly move back and forth in the horizontal direction. In one embodiment, the allowance for such movement is 5 mm in either back or forth direction. As shown in FIG. 5A, the handle 340 is attached to the shaft 210 in such a way that when the handle 340 swings, the shaft 210 rotates the same angle.

Referring again to FIG. 5A, the holding plate 330 which is mounted to the frame 118, is curved to accommodate the swing of the handle 340. The holding plate 330 has a plurality of slots 332 for securing the handle 340 to a desired position.

FIG. 5B is a side view of the handle 340 disengaging the holding plate 330. When the handle 340 is pulled pivoting away from the frame 118, the handle 340 disengaging the holding plate 330 and can swing to a different position. When being released, the handle 340 is pulled by a spring 520 pivoting toward the frame 118, and slides into a slot 332 to be secured in a desired position. As shown in FIG. 5B, one end of the spring 520 is attached to the handle 340 while another end of the spring 520 is attached to the shaft 210.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A passive-type treadmill comprising:

a closed-loop belt rolling around a first and a second roller for providing a running platform, the first and second rollers being space apart;

a resistance wheel contacting the first roller for providing resistance to the rotation of the first roller a shaft, the resistance wheel being capable of rotating around said shaft; and a spring urging the shaft and thus the resistance wheel against the first roller.

2. The passive-type treadmill of claim 1, wherein the resistance wheel is made of a rubber material.

3. The passive-type treadmill of claim 1 further comprising an oval wheel fixed to the shaft, the oval wheel having an circumferential surface point contacting the spring, when the oval wheel rotating to a first angle, the oval wheel having a first distance from the shaft to the circumferential surface point, and when the oval wheel rotating to a second angle the oval wheel having a second distance from the shaft to the circumferential surface point, wherein the first distance and the second distance are different.

4. The passive-type treadmill of claim 3, wherein the spring has an end member with a smooth surface contacting the circumferential surface point of the oval wheel.

5. The passive-type treadmill of claim 1 further comprising a rigid frame with a side rail for mounting the first and the second rollers.

6. The passive-type treadmill of claim 5, wherein an end of the spring is mounted to a protruding member of the side rail.

7. The passive-type treadmill of claim 5, wherein the side rail has a slot with a first end of the shaft inserted therein, the slot confining and allowing a predetermined amount of movement by the shaft.

8. The passive-type treadmill of claim 7 further comprising a lever pivotally attached to the first end of the shaft for rotating the shaft.

9. The passive-type treadmill of claim 8 further comprising a locking plate with a plurality of notches space apart thereon for locking the lever in a desired location.

10. The passive-type treadmill of claim 9 wherein the locking plate is curved.

11. The passive-type treadmill of claim 9 wherein the locking plate is mounted to the side rail.

12. The passive-type treadmill of claim 9 further comprising a spring attached to the lever for urging the lever to pivot toward the locking plate.

13. A passive-type treadmill comprising:

a closed-loop belt rolling around a first and a second roller for providing a running platform, the first and second rollers being space apart;

a resistance wheel contacting the first roller for providing resistance to the rotation of the first roller a shaft, the resistance wheel being capable of rotating around said shaft;

a spring urging the shaft and thus the resistance wheel against the first roller; and a rotatable member for adjusting force of the spring.

14. The passive-type treadmill of claim 13, wherein the resistance wheel is made of a rubber material.

15. The passive type treadmill of claim 13, wherein the rotatable member is a bolt.

16. The passive-type treadmill of claim 13 wherein the rotatable member is an oval wheel fixed to the shaft, the oval wheel having an circumferential surface point contacting the spring, when the oval wheel rotating to a first angle, the oval wheel having a first distance from the shaft to the circumferential surface point, and when the oval wheel rotating to a second angle the oval wheel having a second distance from the shaft to the circumferential surface point, wherein the first distance and the second distance are different.

17. The passive-type treadmill of claim 16, wherein the spring has an end member with a smooth surface contacting the circumferential surface point of the oval wheel.

18. The passive-type treadmill of claim 13 further comprising a rigid frame with a side rail for mounting the first and the second rollers.

19. The passive-type treadmill of claim 18, wherein an end of the spring is mounted to a protruding member of the side rail.

20. The passive-type treadmill of claim 13 further comprising a lever pivotally attached to a first end of the shaft for rotating the shaft.

* * * * *